US007264185B2

(12) United States Patent
Tomikawa et al.

(10) Patent No.: US 7,264,185 B2
(45) Date of Patent: Sep. 4, 2007

(54) DRY GRINDING SYSTEM AND DRY GRINDING METHOD

(75) Inventors: Shinichiro Tomikawa, Shiojiri (JP); Hirokazu Miyazawa, Shiojiri (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 11/449,655

(22) Filed: Jun. 9, 2006

(65) Prior Publication Data

US 2006/0255192 A1 Nov. 16, 2006

Related U.S. Application Data

(62) Division of application No. 10/686,522, filed on Oct. 16, 2003, now Pat. No. 7,083,130.

(60) Provisional application No. 60/421,783, filed on Oct. 29, 2002.

(30) Foreign Application Priority Data

Oct. 18, 2002 (JP) ..... 2002-304390

(51) Int. Cl.
*B02C 23/14* (2006.01)

(52) U.S. Cl. ..... 241/19; 241/24.14; 241/24.15; 241/80

(58) Field of Classification Search ..... 241/24.14, 241/24.15, 19, 80
See application file for complete search history.

(56) References Cited

FOREIGN PATENT DOCUMENTS

| | | | |
|---|---|---|---|
| JP | 05-038464 | A | 2/1993 |
| JP | 05-330819 | A | 12/1993 |
| JP | 06-313990 | A | 11/1994 |
| JP | 07-092735 | A | 4/1995 |
| JP | 11-015195 | A | 1/1999 |

*Primary Examiner*—Mark Rosenbaum
(74) *Attorney, Agent, or Firm*—Sughrue Mion, PLLC

(57) ABSTRACT

The invention provides a dry grinding system including grinding means for dry-grinding a material to be ground; first classification means for classifying a ground product obtained through the grinding means, into fine powder having a relatively small average particle size and coarse powder having a relatively large average particle size; second classification means for further classifying the coarse powder obtained through the first classification means, into find powder having a relatively small average particle size and coarse powder having a relatively large average particle size; and returning means for returning to the grinding means the coarse powder obtained through the second classification means. The invention enables production of a powder product having a desired average particle size at high efficiency.

4 Claims, 4 Drawing Sheets

DRY GRINDING SYSTEM AND DRY GRINDING METHOD

CROSS-REFERENCE TO RELATED APPLICATIONS

This application is a divisional of application Ser. No. 10/686,522, filed Oct. 16, 2003, now U.S. Pat. No. 7,083,130 which claims benefit pursuant to 35 of U.S.C. §119(e)(1) of the filing date of Provisional Application No. 60/421,783, filed Oct. 29, 2002, pursuant to 35 U.S.C. §111(b).

BACKGROUND OF THE INVENTION

1. Field of the Invention

The present invention relates to a dry grinding system which is suitable for use in production of, for example, abrasives or fillers; and to a dry grinding method employing the system.

Priority is claimed on Japanese Patent Application No. 2002-304390, filed Oct. 18, 2002, the content of which is incorporated herein by reference.

2. Description of Related Art

In general, ceramic powder such as alumina powder or silicon carbide powder, which is employed as, for example, abrasives or fillers, is produced through grinding of raw material powder having a large average particle size. Grinding processes are roughly classified into batch grinding processes and continuous grinding processes. Continuous grinding processes are roughly classified into an open-circuit grinding process and a closed-circuit grinding process. Among these grinding processes, a continuous grinding process; particularly, a closed-circuit grinding process, is widely employed by virtue of its excellent grinding efficiency. Grinding processes include a dry grinding process and a wet grinding process. When a dry product is to be produced by means of a grinding process, in many cases, a dry grinding process, which does not require a drying step, is employed.

An exemplary dry closed-circuit grinding system is described in "Chemical Engineering Handbook" published by Maruzen, Oct. 25, 1978, page 1265. The grinding system will next be schematically described with reference to FIG. 4.

As shown in FIG. 4, the conventional dry closed-circuit grinding system includes grinding means 120 for dry-grinding a material to be ground 110; classification means 130 for classifying a ground product 121 obtained through the grinding means 120, into fine powder 131 having a relatively small average particle size and coarse powder 132 having a relatively large average particle size; and returning means 140 for returning to the grinding means 120 the coarse powder 132 obtained through the classification means 130.

In this system, the fine powder 131 obtained through the classification means 130 is collected, and the coarse powder 132 is repeatedly subjected to grinding until the resultant powder attains a predetermined average particle size. The above-collected fine powder finds utility in a variety of applications without any further treatment, or, if desired, after being subjected to further classification.

However, the aforementioned conventional dry grinding system sometimes fail to attain an efficient production of a powder product having a target average particle size.

Alumina powder suitable for use as abrasives, etc. has an average particle size of, for example, 45 to 90 μm. In the case where an alumina powder product having such an average particle size is to be produced by subjecting, to further classification, alumina fine powder obtained through the classification means of the aforementioned conventional system, when a medium size crusher is employed as the grinding means, the fine powder contains large amounts of particles having a particle size greater than a target particle size; i.e., the amount of particles having a particle size falling within a target particle size range is reduced, and therefore the productivity is low.

Employment of a pulverizer as the grinding means should be a possible solution for increasing the amount of particles contained in the fine powder that have a particle size falling within a target particle size range. However, in this case, the fine powder contains large amounts of ultrafine particles, and thus classification efficiency of the fine powder is lowered, leading to low productivity.

BRIEF SUMMARY OF THE INVENTION

In view of the foregoing, the present invention contemplates provision of a dry grinding system and a dry grinding method, which can produce at high efficiency a powder product having a target average particle size.

In order to solve the aforementioned problems, the present inventors have performed extensive studies, and have accomplished the present invention on the basis of the results therefrom.

The present invention provides a dry grinding system and a dry grinding method, as described below.

(1) A dry grinding system comprising:

grinding means for dry-grinding a material to be ground;

first classification means for classifying a ground product obtained through the grinding means, into fine powder having a relatively small average particle size and coarse powder having a relatively large average particle size;

second classification means for further classifying the coarse powder obtained through the first classification means, into fine powder having a relatively small average particle size and coarse powder having a relatively large average particle size; and returning means for returning to the grinding means the coarse powder obtained through the second classification means.

(2) A dry grinding system according to (1) above, which further comprises:

third classification means for further classifying the fine powder obtained through the second classification means, into fine powder having a relatively small average particle size and coarse powder having a relatively large average particle size; and returning means for returning to the grinding means the coarse powder obtained through the third classification means.

(3) A dry grinding system according to (1) above, wherein the grinding means is a ball mill.

(4) A dry grinding system according to (1) above, wherein the first classification means is an air classifier.

(5) A dry grinding system according to (1) above, wherein the second classification means is a sieve.

(6) A dry grinding system according to (2) above, wherein the third classification means is a sieve.

(7) A dry grinding system according to (5) above, wherein the second classification means includes:

classification means for further classifying the resultant fine powder into ultrafine powder having a relatively small average particle size and fine powder having a relatively large average particle size; and returning means for returning to the grinding means the ultrafine powder obtained through this classification means.

(8) A dry grinding system according to (6) above, wherein the third classification means includes:

classification means for further classifying the resultant fine powder into ultrafine powder having a relatively small average particle size and fine powder having a relatively large average particle size; and returning means for returning to the grinding means the ultrafine powder obtained through this classification means.

(9) A dry grinding system according to (1) above, which further comprises collection means for collecting the fine powder obtained through the first classification means, and collection means for collecting the fine powder obtained through the second classification means, wherein the collection means for collecting the fine powder obtained through the second classification means includes means for removing iron.

(10) A dry grinding system according to (2) above, which further comprises collection means for collecting the fine powder obtained through the first classification means, and collection means for collecting the fine powder obtained through the third classification means, wherein the collection means for collecting the fine powder obtained through the third classification means includes means for removing iron.

(11) A dry grinding system according to (9) or (10) above, wherein the fine powder obtained through the first classification means has an average particle size of 5 to 25 μm.

(12) A dry grinding system according to (9) above, wherein the fine powder obtained through the second classification means has an average particle size of 45 to 90 μm, and a bulk density of 1.7 to 2.3.

(13) A dry grinding system according to (10) above, wherein the fine powder obtained through the third classification means has an average particle size of 45 to 90 μm, and a bulk density of 1.7 to 2.3.

(14) A dry grinding system according to (1) above, wherein the material to be ground is alumina.

(15) A dry grinding method comprising:

a grinding step of dry-grinding a material to be ground;

a first classification step of classifying a ground product obtained through the grinding step, into fine powder having a relatively small average particle size and coarse powder having a relatively large average particle size;

a second classification step of further classifying the coarse powder obtained through the first classification step, into fine powder having a relatively small average particle size and coarse powder having a relatively large average particle size; and a returning step of returning to the grinding step the coarse powder obtained through the second classification step.

(16) A dry grinding method according to (15) above, wherein the second classification step includes:

a classification step of further classifying the resultant fine powder into ultrafine powder having a relatively small average particle size and fine powder having a relatively large average particle size; and a returning step of returning to the grinding step the ultrafine powder obtained through this classification step.

(17) A dry grinding method according to (15) or (16) above, which further comprises a collection step of collecting the fine powder obtained through the first classification step, and a collection step of collecting the fine powder obtained through the second classification step, wherein the collection step of collecting the fine powder obtained through the second classification step includes a step of removing iron.

(18) A dry grinding method according to (15) above, which further comprises:

a third classification step of further classifying the fine powder obtained through the second classification step, into fine powder having a relatively small average particle size and coarse powder having a relatively large average particle size; and a returning step of returning to the grinding step the coarse powder obtained through the third classification step.

(19) A dry grinding method according to (18) above, wherein the third classification step includes:

a classification step of further classifying the resultant fine powder into ultrafine powder having a relatively small average particle size and fine powder having a relatively large average particle size; and a returning step of returning to the grinding step the ultrafine powder obtained through this classification step.

(20) A dry grinding method according to (18) or (19) above, which further comprises a collection step of collecting the fine powder obtained through the first classification step, and a collection step of collecting the fine powder obtained through the third classification step, wherein the collection step of collecting the fine powder obtained through the third classification step includes a step of removing iron.

As described above, a characteristic feature of the dry grinding system of the present invention resides in that the system includes grinding means for dry-grinding a material to be ground; first classification means for classifying a ground product obtained through the grinding means, into fine powder having a relatively small average particle size and coarse powder having a relatively large average particle size; second classification means for further classifying the coarse powder obtained through the first classification means, into fine powder having a relatively small average particle size and coarse powder having a relatively large average particle size, the second classification means including, if desired, classification means for further classifying the fine powder obtained through the second classification means, into ultrafine powder having a relatively small average particle size and fine powder having a relatively large average particle size; and returning means for returning to the grinding means the ultrafine powder and the coarse powder obtained through the second classification means.

Preferably, the dry grinding system of the present invention further includes collection means for collecting the fine powder obtained through the first classification means, and collection means for collecting the fine powder obtained through the second classification means, wherein the collection means for collecting the fine powder obtained through the second classification means includes means for removing iron.

The dry grinding system of the present invention may further include third classification means for further classifying the fine powder obtained through the second classification means, into fine powder having a relatively small average particle size and coarse powder having a relatively large average particle size, the third classification means including, if desired, classification means for further classifying the fine powder obtained through the third classification means, into ultrafine powder having a relatively small average particle size and fine powder having a relatively large average particle size; and returning means for returning to the grinding means the ultrafine powder and the coarse powder obtained through the third classification means.

In the case where the dry grinding system has the aforementioned configuration, preferably, the system further includes collection means for collecting the fine powder obtained through the first classification means, and collection means for collecting the fine powder obtained through the third classification means, wherein the collection means for collecting the fine powder obtained through the third classification means includes means for removing iron.

In the dry grinding system of the present invention, preferably, the grinding means is a ball mill, the first classification means is an air classifier, and each of the second and third classification means is a sieve.

The fine powder obtained through the first classification means preferably has an average particle size of 5 to 25 μm. The fine powder obtained through the second or third classification means preferably has an average particle size of 45 to 90 μm and a bulk density of 1.7 to 2.3. The material to be ground is preferably a ceramic material such as alumina or silicon carbide, particularly preferably alumina.

A characteristic feature of the dry grinding method of the present invention resides in that the method includes a grinding step of dry-grinding a material to be ground; a first classification step of classifying a ground product obtained through the grinding step, into fine powder having a relatively small average particle size and coarse powder having a relatively large average particle size; a second classification step of further classifying the coarse powder obtained through the first classification step, into fine powder having a relatively small average particle size and coarse powder having a relatively large average particle size, the second classification step including, if desired, a classification step of further classifying the fine powder obtained through the second classification step, into ultrafine powder having a relatively small average particle size and fine powder having a relatively large average particle size; and a returning step of returning to the grinding step the ultrafine powder and the coarse powder obtained through the second classification step.

Preferably, the dry grinding method of the present invention further includes a collection step of collecting the fine powder obtained through the first classification step, and a collection step of collecting the fine powder obtained through the second classification step, wherein the collection step of collecting the fine powder obtained through the second classification step includes a step of removing iron.

The dry grinding method may further include, instead of the collection step of collecting the fine powder obtained through the second classification step, a third classification step of further classifying the fine powder obtained through the second classification step, into fine powder having a relatively small average particle size and coarse powder having a relatively large average particle size, the third classification step including, if desired, a classification step of further classifying the fine powder obtained through the third classification step, into ultrafine powder having a relatively small average particle size and fine powder having a relatively large average particle size; and a returning step of returning to the grinding step the ultrafine powder and the coarse powder obtained through the third classification step.

In this case, preferably, the dry grinding method includes a collection step of collecting the fine powder obtained through the first classification step, and a collection step of collecting the fine powder obtained through the third classification step, wherein the collection step of collecting the fine powder obtained through the third classification step includes a step of removing iron.

The present invention provides a dry grinding system and a dry grinding method, which can produce at high efficiency a powder product having a target average particle size.

DETAILED DESCRIPTION OF THE INVENTION

FIRST EMBODIMENT

Next will be described a dry grinding system according to a first embodiment of the present invention and a dry grinding method employing the system with reference to FIG. 1.

Figure 1:
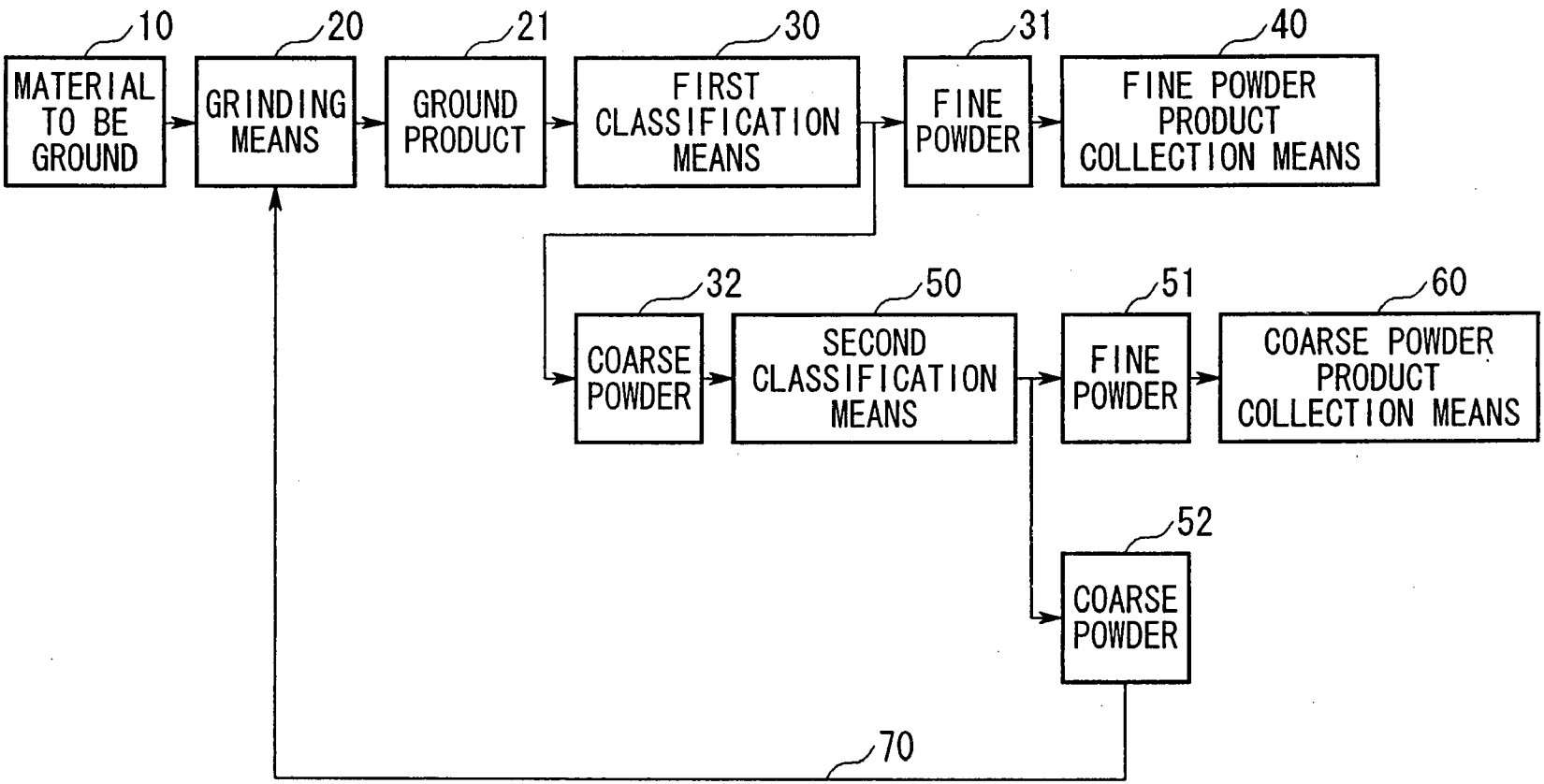
FIG. 1 shows a dry grinding system and dry grinding method according to a first embodiment of the present invention.

As shown in FIG. 1, the dry grinding system of the present embodiment includes grinding means 20 for dry-grinding a material to be ground 10; first classification means 30 for classifying a ground product 21 obtained through the grinding means 20, into fine powder 31 having a relatively small average particle size and coarse powder 32 having a relatively large average particle size; second classification means 50 for further classifying the coarse powder 32 obtained through the first classification means 30, into fine powder 51 having a relatively small average particle size and coarse powder 52 having a relatively large average particle size, the second classification means 50 including, if desired, classification means (not illustrated) for further classifying the fine powder 51 obtained through the second classification means 50, into ultrafine powder having a relatively small average particle size and fine powder having a relatively large average particle size; and returning means 70 for returning to the grinding means 20 the ultrafine powder (not illustrated) and the coarse powder 52 obtained through the second classification means 50.

The dry grinding system of the present embodiment further includes fine powder product collection means 40 for collecting, as a "fine powder product," the fine powder 31 obtained through the first classification means 30; and coarse powder product collection means 60 for collecting, as a "coarse powder product," the fine powder 51 obtained through the second classification means 50. Preferably, the coarse powder product collection means 60 includes iron removal means (not illustrated) for removing iron components from the fine powder 51.

As used herein, the terms "fine powder product" and "coarse powder product" refer to a powder product having a relatively small average particle size and a powder product having a relatively large average particle size, respectively, the powder products being produced by use of the system of the present embodiment.

The dry grinding method of the present embodiment, which employs the aforementioned system, includes a grinding step of dry-grinding a material to be ground 10; a first classification step of classifying a ground product 21 obtained through the grinding step, into fine powder 31 having a relatively small average particle size and coarse powder 32 having a relatively large average particle size; a second classification step of further classifying the coarse powder 32 obtained through the first classification step, into fine powder 51 having a relatively small average particle size and coarse powder 52 having a relatively large average particle size, the second classification step including, if desired, a classification step of further classifying the fine powder 51 obtained through the second classification step, into ultrafine powder having a relatively small average particle size and fine powder having a relatively large average particle size; and a returning step of returning to the grinding step the ultrafine powder and the coarse powder 52 obtained through the second classification step. Preferably, the dry grinding method further includes a collection step of collecting the fine powder 31 obtained through the first classification step, and a collection step of collecting the fine powder 51 obtained through the second classification step, wherein the collection step of collecting the fine powder 51 obtained through the second classification step includes a step of removing iron.

In the present embodiment, no particular limitations are imposed on the material to be ground 10. Examples of the material include ceramic materials such as alumina and silicon carbide. The material preferably assume a powdery form.

Alumina powder is employed in a variety of products. For example, when alumina powder is incorporated, as a filler, into a resin composition, the powder can impart high wear resistance and high transparency to the composition. Specific examples of the raw material suitable for producing alumina powder include electro-fused alumina.

No particular limitations are imposed on the physical properties of the fine powder product obtained through the first classification means 30 and the coarse powder product obtained through the second classification means 50. The physical properties of these products are appropriately determined in accordance with, for example, use thereof.

The fine powder product obtained through the first classification means 30 preferably has an average particle size falling within a range of 5 to 25 μm, more preferably 10 to 20 μm.

When the average particle size of the fine powder product is less than 5 μm, the amount of ultrafine particles contained in the coarse powder 32 increases, and classification efficiency of the second classification step, where the coarse powder 32 is again subjected to classification, may be unpreferably lowered. In contrast, when the average particle size of the fine powder product exceeds 25 μm, the amount of the particles contained in the fine powder product that have a particle size falling within a target particle size range is decreased, and the amount of the coarse powder product to be collected is unpreferably decreased.

Meanwhile, the coarse powder product obtained through the second classification means 50 preferably has an average particle size falling within a range of 45 to 90 μm, more preferably 55 to 75 μm. The coarse powder product preferably has a bulk density falling within a range of 1.7 to 2.3, more preferably 1.8 to 2.1.

In the case where the average particle size of the coarse powder product is less than 45 μm, when the product is incorporated, as a filler, into a resin composition, dispersibility of the product in the composition is impaired, which may cause deterioration of characteristics of the resin composition (e.g., non-uniformity of the composition). In contrast, in the case where the average particle size of the coarse powder product exceeds 90 μm, when the product is incorporated, as a filler, into a resin composition, the composition may contain particles having a size greater than the thickness of the resultant resin layer, and thus characteristics of the resin layer may be deteriorated; for example, surface smoothness of the layer may be deteriorated. In the case where the bulk density of the coarse powder product is less than 1.7, when the powder product is incorporated, as a filler, into a resin composition, filling performance of the powder product is poor. In the case where a coarse powder product having a bulk density in excess of 2.3, the residence time of the material to be ground within the grinding means 20 must be prolonged, leading to over-grinding and poor production efficiency.

As used herein, "average particle size" is measured by means of laser diffractometry and the method specified by "JIS R 6002: 1998-3, test method type: a) screening test method," and "bulk density" is measured by means of the method specified by "JIS R 6126-1970." Specifically, "average particle size" and "bulk density" are measured as follows.

1. Measurement of average particle size (JIS R 6002, screening test method):

1.1 Apparatus and standard samples 1.1.1 Test apparatus: Ro-Tap test apparatus (rate of tapping: 156 shocks/min, rotation speed: 290 rpm).

1.1.2 Sieve: Test sieves, each having an inner diameter of 200 mm and an inner depth of 45 mm, are employed.

1.1.3 Standard sample: The standard sample used for correcting results of screening is brown aluminous abrasives which are classified into graded grain sizes of standard particle size distribution and given reference numerical values.

1.2 Procedure

The screening test is performed through the following procedure.

a) A sample (100 g) is weighed.

b) Test sieves of different mesh sizes as specified by JIS Z 8801 (e.g., "JIS Z 8801 test sieves," each having a diameter of 200 mm and a height of 45 mm, products of Iida Seisakusho Corporation) are placed in the test apparatus such that the test sieves are stacked atop a receiving tray one on another in sequence of upwardly increasing mesh opening size.

c) The sample is placed on the uppermost test sieve, and the test sieves are vibrated by the test apparatus for five minutes.

d) The mass of a portion of the sample that remains on each of the sieves or on the receiving tray is measured to a precision of 0.1 g. In the case where the total mass of the sample is calculated as 99.0 g or less, the test is performed again.

1.3 Calculation

The mass percentage of the above-screened portion of the sample is calculated.

1.4 Correction by use of the standard sample

The thus-calculated value is corrected by reference to the standard sample, and the thus-corrected value is taken as a measurement value.

2. Measurement of bulk density (JIS R 6126):

2.1 A sample (about 120 mL) is collected and dried.

Figure 2:
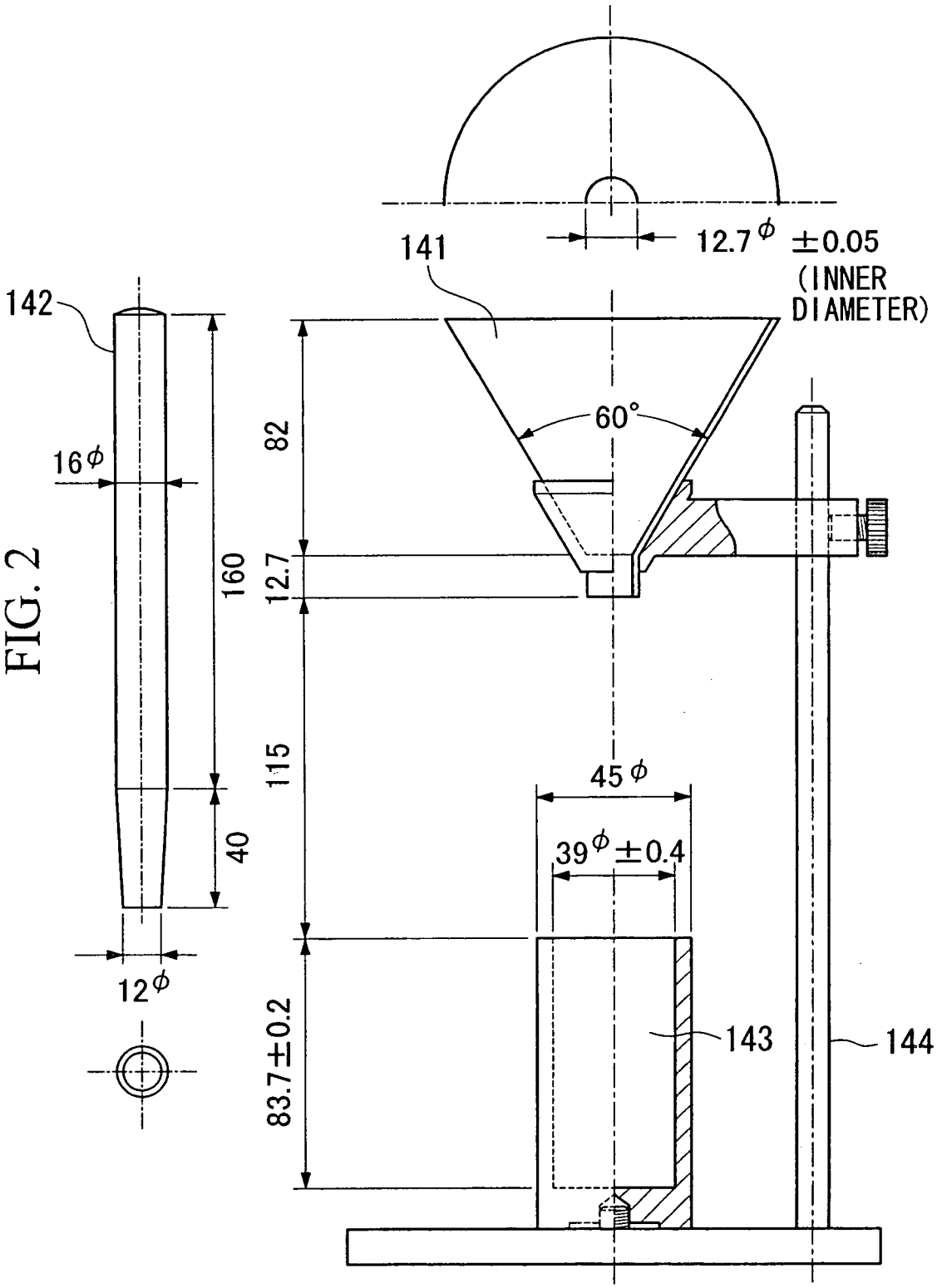
FIG. 2 is a schematic view showing an system employed for bulk density measurement, the system being described herein.

2.2 Test method 2.2.1 Apparatus: there is employed a test apparatus shown in FIG. 2, which includes a funnel 141, a stopper 142, a cylinder 143, and a supporter 144, each of the members having dimensions (unit: mm) shown in FIG. 2. The materials of the respective members are described below.

Funnel 141: stainless steel

Stopper 142: brass

Cylinder 143: brass (formed of a seamless brass tube and a brass bottom)

(The dimensions and shape of portions of the aforementioned members, the dimensions and shape being not specified in FIG. 2, may be appropriately determined.)

2.2.2 Procedure (1) The volume of the cylinder 143 is correctly measured by use of tap water, to a precision of 0.1 mL.

(2) The outlet of the funnel 141 is closed by use of the stopper 142, the sample about 120 mL) is placed in the funnel, and then the cylinder 143 is placed directly below the funnel 141.

(3) The stopper 142 is removed from the funnel, to thereby cause the entirety of the sample to fall into the cylinder 143. Any portion of the sample that stands above the rim of the cylinder 143 is scooped by use of a metallic plate, while the metallic plate is brought into contact with the upper end of the cylinder 143 such that the angle between the plate and the upper end of the cylinder 143 is 30 to 45°. Subsequently, the sample contained in the cylinder is correctly weighed, to a precision of 0.1 g.

(4) The sample is subjected three times to a cycle including the above steps (2) and (3). When the difference between the maximum and the minimum of the weights of the sample as measured in the three cycles is 1.0 g or more, the sample is subjected to the cycle an additional time and this procedure is continued until the difference between the maximum and the minimum of three weights of the sample is found to be less than 1.0 g, when the three weights are employed for calculation of bulk density.

2.2.3 Calculation

Bulk density is calculated by use of the following formula.

$$\text{Bulk density}=\{(W_1+W_2+W_3)/3\}\div V\ (\text{g/mL})$$

$W_1$, $W_2$, $W_3$: the weight of the sample contained in the cylinder as measured in the respective cycle (g)

V: the volume of the cylinder (mL)

No particular limitations are imposed on the grinding means 20, so long as the means can grind the material to be ground 10. The grinding means 20 can be appropriately chosen in accordance with, for example, the intended physical properties of a powder product.

For example, when a fine powder product having an average particle size of 5 to 25 μm and a coarse powder product having an average particle size of 45 to 90 μm and a bulk density of 1.7 to 2.3 are produced, preferably, a grinding apparatus which is generally defined as an "pulverizer" is employed as the grinding means. Particularly, a ball mill is preferred. When a ball mill is employed as the grinding means, a fine powder product and a coarse powder product having the aforementioned physical properties can be produced at high efficiency. A ball mill is advantageous from the viewpoint of equipment cost, since it is an inexpensive pulverizer.

No particular limitations are imposed on the first classification means 30, so long as the means enables classification of the ground product 21 obtained through the grinding means 20. Examples of the classification means include an air classifier and a sieve. Of these, an air classifier is preferred, since it attains high classification efficiency of the fine powder 31; i.e., high collection efficiency of a fine powder product.

No particular limitations are imposed on the second classification means 50, so long as the means enables classification of the coarse powder 32 obtained through the first classification means 30. Examples of the classification means include an air classifier and a sieve. Of these, a sieve is preferred, since it attains high classification efficiency of the fine powder 51; i.e., high collection efficiency of a coarse powder product.

Examples of the iron removal means for removing iron components from the fine powder 51 (coarse powder product) include a magnetic separator. When such iron removal means is provided, iron components, which have entered the powder during, for example, the grinding step or the classification step, can be removed from the powder, and thus a high-quality coarse powder product containing small amounts of impurities can be produced.

If desired, iron removal means similar to that described above may be provided in the fine powder collection means 40 for collecting the fine powder 31 (fine powder product).

In the dry grinding system of the present embodiment and the dry grinding method employing the system, the fine powder 31 obtained through the first classification means 30 is collected as a "fine powder product," the coarse powder 32 is further classified into the fine powder 51 and the coarse powder 52 through the second classification means 50, and the resultant fine powder 51 is collected as a "coarse powder product."

As described above, in the present embodiment, two types of powder products having different average particle sizes are collected in two different steps. The thus collected "fine powder product" and "coarse powder product" can be applied to different uses. Each of the thus-collected powder products contains large amounts of particles having a particle size falling within a target particle size range; i.e., the powder product can be produced at high efficiency. Since, after the coarse powder 32 is separated from the fine powder 31 containing ultrafine particles through classification, the coarse powder 32 is further subjected to classification through the second classification means 50, adverse effects of the ultrafine particles on classification of the coarse powder 32 can be lowered. Therefore, lowering of classification efficiency in the second classification step, which is caused by the presence of the ultrafine particles, will never be incurred.

Thus, the system of the present embodiment can produce at very high efficiency powder products having a target average particle size. (e.g., a fine powder product having an average particle size of 5 to 25 μm, and a coarse powder product having an average particle size of 45 to 90 μm and a bulk density of 1.7 to 2.3).

The system of the present embodiment employs a grinding apparatus (e.g., a ball mill) as the grinding means 20. Therefore, the system can produce at high efficiency a coarse powder product whose bulk density is 42 to 58% of its true specific gravity; i.e., a coarse powder product having a high bulk density (e.g., an alumina coarse powder product having a bulk density of 1.7 to 2.3 (true specific gravity of the product: 3.98)).

When alumina (e.g., electro-fused alumina), serving as a raw material, is dry-ground by use of the system of the present embodiment, there can be produced at high efficiency alumina powder exhibiting physical properties suitable for use as, for example, abrasives or fillers. Particularly, an alumina coarse powder product produced by use of the system of the present embodiment exhibits excellent compatibility in a resin. Therefore, when the coarse powder product is incorporated, as a filler, into a resin composition, high filling ratio is attained, and the resultant resin, composition exhibits high transparency.

SECOND EMBODIMENT

Next will be described a dry grinding system according to a second embodiment of the present invention and a dry grinding method employing the system with reference to FIG. 3. Components corresponding to those of the first embodiment are denoted by common reference numerals, and repeated description is omitted.

The dry grinding system of the present embodiment differs from that of the first embodiment in that the system includes third classification means 80 for further classifying the fine powder 51 obtained through the second classification means 50, the fine powder 51 is not collected in the case of the present embodiment, into fine powder 81 having a relatively small average particle size and coarse powder 82 having a relatively large average particle size, the third classification means 80 including, if desired, classification means (not illustrated) for further classifying the fine powder 81 obtained through the third classification means 80, into ultrafine powder having a relatively small average particle size and fine powder having a relatively large average particle size; and returning means 100 for returning to the grinding means 20 the ultrafine powder (not illustrated) and the coarse powder obtained through the third classification means 80.

The system of the present embodiment includes, instead of the coarse powder product collection means for collecting, as a coarse powder product, the fine powder 51 obtained through the second classification means 50, coarse powder product collection means 90 for collecting, as a coarse powder product, the fine powder 81 obtained through the third classification means 80. As in the case of the first embodiment, preferably, the coarse powder product collection means 90 includes iron removal means (not illustrated) for removing iron components from the fine powder 81.

No particular limitations are imposed on the third classification means 80, so long as the means enables classification of the fine powder 51 obtained through the second classification means 50. Examples of the third classification means include an air classifier and a sieve. Of these, a sieve is preferred, since it attains high classification efficiency of the fine powder 81; i.e., high collection efficiency of a coarse powder product.

The dry grinding method of the present embodiment differs from that of the first embodiment in that the method includes a third classification step of further classifying the fine powder 51 obtained through the second classification step, into fine powder 81 having a relatively small average particle size and coarse powder 82 having a relatively large average particle size, the third classification step including, if desired, a classification step of further classifying the fine powder 81 obtained through the third classification step, into ultrafine powder having a relatively small average particle size and fine powder having a relatively large average particle size; and a returning step of returning to the grinding step the ultrafine powder and the coarse powder 82 obtained through the third classification step.

In the present embodiment, the fine powder 51 obtained through the second classification means 50 is further classified into the fine powder 81 and the coarse powder 82, and the fine powder 81 is collected as a coarse powder product. Therefore, the present embodiment exhibits, in addition to the effects obtained from the first embodiment, the following effects: a coarse powder product exhibiting more stable particle size distribution can be produced, and the amount of particles contained in the coarse powder product that have a particle size falling within a target particle size range can be further increased.

EXAMPLES

The present invention will next be described by way of Examples.

Example 1

Dry closed-circuit grinding was performed by use of a dry grinding system similar to that of the first embodiment.

Coarsely ground electro-fused alumina (particle size: 2 mm or less) was employed as a material to be ground. A vibration ball mill having an inner capacity of 0.5 $m^3$ (grinding media: alumina balls, percent filling: 70%) was employed as grinding means. A forced-vortex air classifier (model: MS-4, product of Hosokawa Micron Corporation) and a circular vibration screen were employed as first classification means and second classification means, respectively. A portion of the dry grinding system with which powder is brought into contact (e.g., a unit or an air conduit), which portion undergoes considerable wear, was coated with a liner (formed of alumina and rubber). Such liner coating attains reduction of the amount of metallic impurities contained in a powder product.

Firstly, the material to be ground was caused to pass through the vibration ball mill at a rate of 800 kg/h. The thus-ground product was subjected to classification through the first classification means (rotation speed: 450 rpm, volume of air: 120 $m^3$), to thereby yield a coarse powder product having an average particle size of 16 μm. Subsequently, coarse particles were removed through the second classification means incorporating a sieve having a mesh size of 125 μm, to thereby produce a coarse powder product having an average particle size of 61 μm and a bulk density of 1.87. The yield of the coarse powder product was found to be 72%. Thus, in the present Example, a powder product having a target average particle size was produced at high efficiency.

Example 2

Dry closed-circuit grinding was performed by use of a dry grinding system similar to that of the second embodiment.

Coarsely ground electro-fused alumina (particle size: 2 mm or less) was employed as a material to be ground. An air-swept rotational ball mill having an inner volume of 1.0 $m^3$ (grinding media: alumina balls, percent filling: 45%) was employed as grinding means. A forced-vortex air classifier (model: MS-1, product of Hosokawa Micron Corporation) was employed as first classification means. A in-plane sieve was employed as second classification means and third classification means.

Firstly, the material to be ground was caused to pass through the rotational ball mill at a rate of 250 kg/h. The thus-ground product was subjected to classification through the first classification means (rotation speed: 1,100 rpm, volume of air: 15 $m^3$), to thereby yield a fine powder product having an average particle size of 11 μm. Subsequently, coarse particles were removed through the second classification means incorporating a sieve having a mesh size of 250 μm. In addition, coarse particles were removed through the third classification means incorporating a sieve having a mesh size of 106 μm, and fine particles were removed through the third classification means incorporating a sieve having a mesh size of 45 μm, to thereby effect size regulation and produce a coarse powder product having an average particle size of 58 μm and a bulk density of 1.93. The yield of the coarse powder product produced through the third classification means was found to be 69%. Thus, in the present Example, a powder product having a target average particle size was produced at high efficiency.

The coarse powder product produced through the third classification means was subjected to iron removal treatment by use of a drum-type magnetic separator, to thereby decrease the amount of iron in the product from 240 ppm to 10 ppm or less.

Example 3

Dry closed-circuit grinding was performed by use of a dry grinding system similar to that of the first embodiment.

Coarsely ground electro-fused mullite (particle size: 1 mm or less) was employed as a material to be ground. An air-swept rotational ball mill having an inner volume of 1.0 $m^3$ was employed as grinding means. A forced-vortex air classifier (model: MS-1, product of Hosokawa Micron Corporation) and a circular vibration screen were employed as first classification means and second classification means, respectively.

Firstly, the material to be ground was caused to pass through the rolling ball mill at a rate of 250 kg/h. The thus-ground product was subjected to classification through the first classification means (rotation speed: 750 rpm, volume of air: 15 $m^3$), to thereby yield a fine powder product having an average particle size of 20 μm. Subsequently, coarse particles were removed through the second classification means incorporating a sieve having a mesh size of 150 μm, and fine particles were removed through the second classification means incorporating a sieve having a mesh size of 53 μm, to thereby effect size regulation and produce a coarse powder product having an average particle size of 74 μm and a bulk density of 1.83. The yield of the coarse powder product produced through the second classification means was found to be 74%. Thus, in the present Example, a powder product having a target average particle size was produced at high efficiency.

Comparative Example

Figure 3:
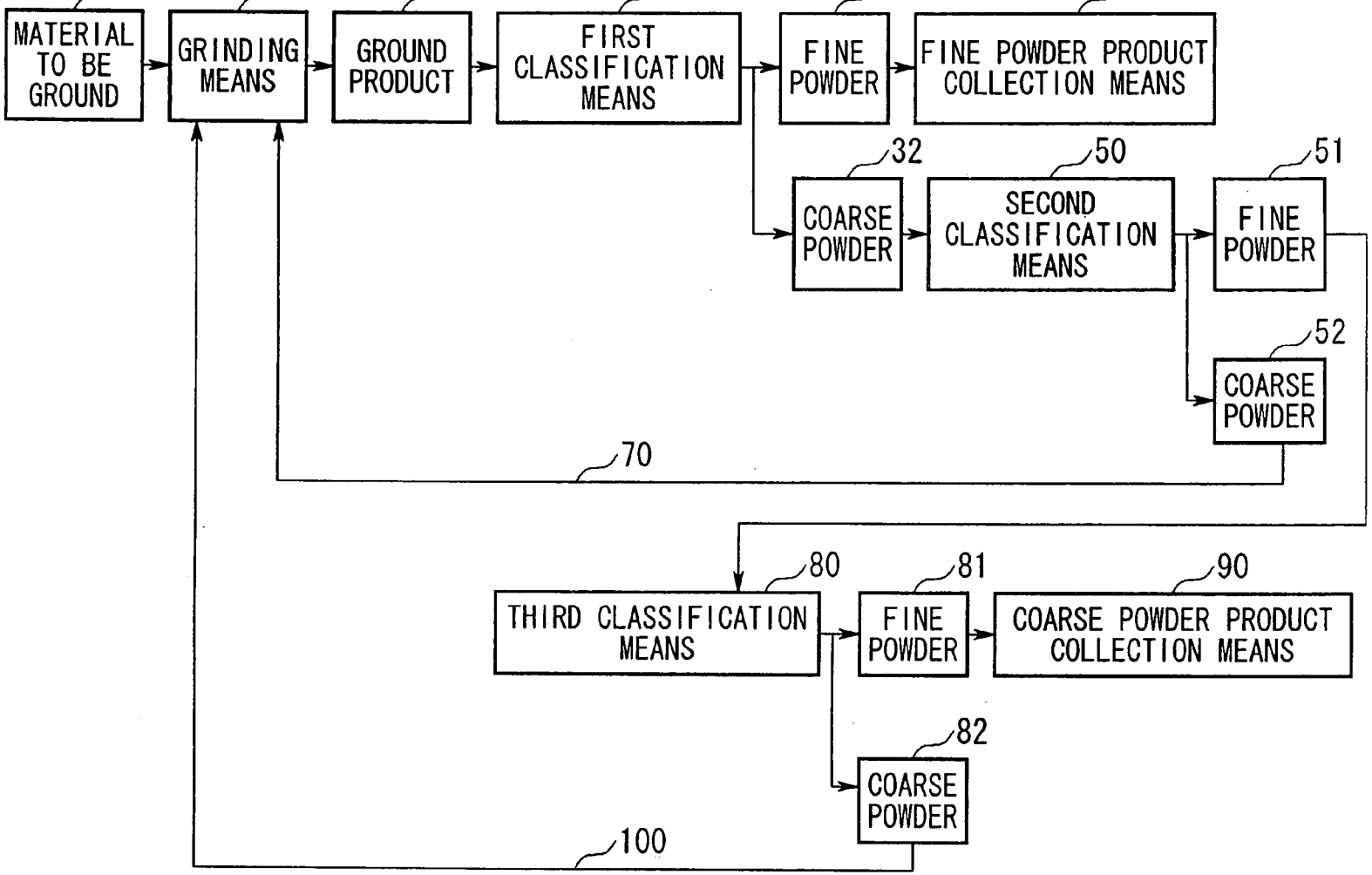
FIG. 3 shows a dry grinding system and dry grinding method according to a second embodiment of the present invention.
Figure 4:
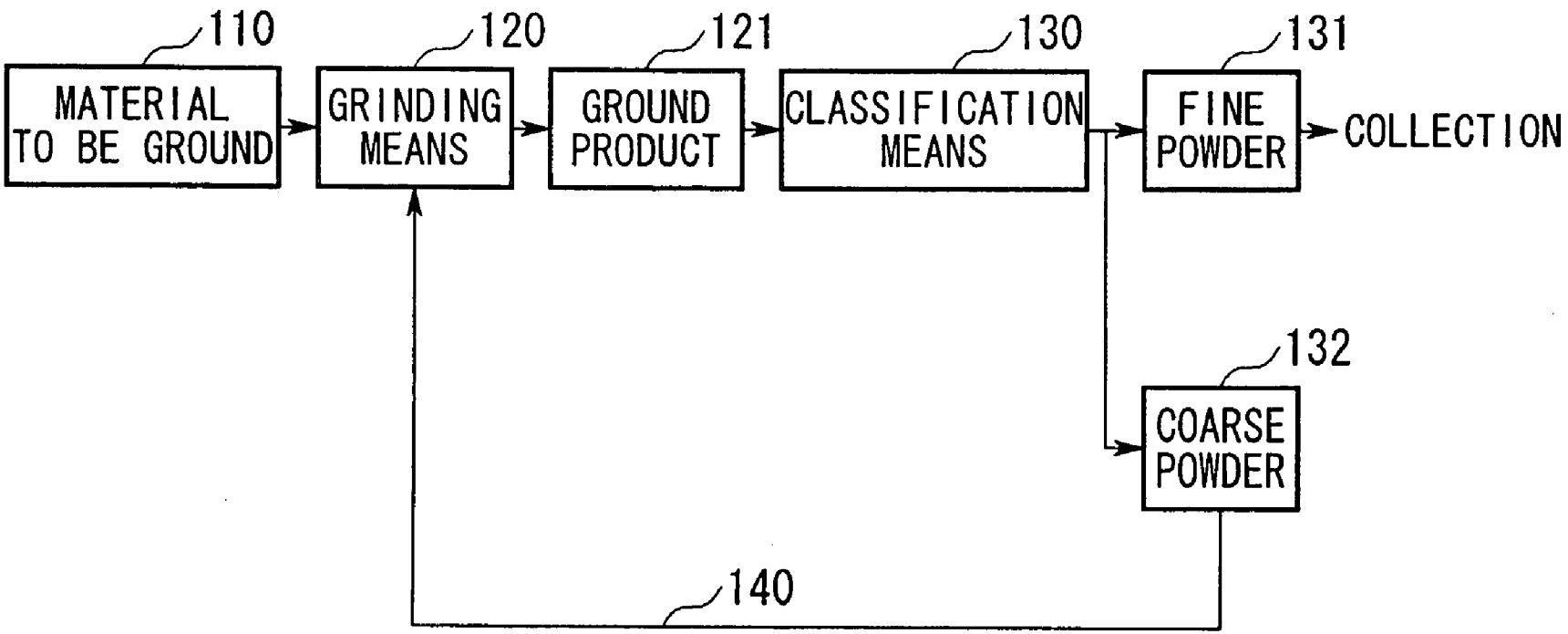
FIG. 4 shows a conventional dry grinding system and dry grinding method.

Dry closed-circuit grinding was performed by use of a dry grinding system shown in FIG. 3.

Coarsely ground electro-fused alumina (particle size: 2 mm or less) was employed as a material to be ground. A vibration ball mill having an inner capacity of 0.5 $m^3$ (grinding media: alumina balls, percent filling: 70%) was employed as grinding means. A circular vibration screen was employed as classification means. In order to form the resultant fine powder into a product, a forced-vortex air classifier (model: MS-1, product of Hosokawa Micron Corporation) was employed as additional classification means.

Firstly, the material to be ground was caused to pass through the vibration ball mill at a rate of 800 kg/h. Subsequently, coarse particles were removed through the classification means incorporating a sieve having a mesh size of 125 μm, to thereby yield fine powder having an average particle size of 45 μm. In addition, fine particles were removed by use of the forced-vortex air classifier (rotation speed: 900 rpm, volume of air: 15 $m^3$), to thereby produce a powder product having an average particle size of 63 μm and a bulk density of 1.95. The yield of the product was found to be 48%.

What is claimed is:

1. A dry grinding method comprising:

a grinding step of dry-grinding a material to be ground;

a first classification step of classifying a ground product obtained through the grinding step, into fine powder having a relatively small average particle size and coarse powder having a relatively large average particle size;

a second classification step of further classifying the coarse powder obtained through the first classification step, into fine powder having a relatively small average particle size and coarse powder having a relatively large average particle size;

and a returning step of returning to the grinding step the coarse powder obtained through the second classification step, wherein the second classification step includes:

a classification step of further classifying the resultant fine powder into ultrafine powder having a relatively small average particle size and fine powder having a relatively large average particle size; and a returning step of returning to the grinding step the ultrafine powder obtained through this classification step.

2. A dry grinding method according to claim 1, which further comprises a collection step of collecting the fine powder obtained through the first classification step, and a collection step of collecting the fine powder obtained through the second classification step, wherein the collection step of collecting the fine powder obtained through the second classification step includes a step of removing iron.

3. A dry grinding method comprising:

a grinding step of dry-grinding a material to be ground;

a first classification step of classifying a ground product obtained through the grinding step, into fine powder having a relatively small average particle size and coarse powder having a relatively large average particle size;

a second classification step of further classifying the coarse powder obtained through the first classification step, into fine powder having a relatively small average particle size and coarse powder having a relatively large average particle size;

a returning step of returning to the grinding step the coarse powder obtained through the second classification step;

a third classification step of further classifying the fine powder obtained through the second classification step, into fine powder having a relatively small average particle size and coarse powder having a relatively large average particle size; and a returning step of returning to the grinding step the coarse powder obtained through the third classification step;

wherein the third classification step includes:

a classification step of further classifying the resultant fine powder into ultrafine powder having a relatively small average particle size and fine powder having a relatively large average particle size; and a returning step of returning to the grinding step the ultrafine powder obtained through this classification step.

4. A dry grinding method according to claim 3, which further comprises a collection step of collecting the fine powder obtained through the first classification step, and a collection step of collecting the fine powder obtained through the third classification step, wherein the collection step of collecting the fine powder obtained through the third classification step includes a step of removing iron.

* * * * *